US009445182B2

(12) United States Patent
Pizzaro et al.

(10) Patent No.: US 9,445,182 B2
(45) Date of Patent: Sep. 13, 2016

(54) HEADPHONES WITH ROTATABLE EAR CUP

(71) Applicants: Camila Pizzaro, Agoura Hills, CA (US); Pascual J. L. Wawoe, Altadena, CA (US)

(72) Inventors: Camila Pizzaro, Agoura Hills, CA (US); Pascual J. L. Wawoe, Altadena, CA (US)

(73) Assignee: David Cohen, Agoura Hills, CA (US)

( * ) Notice: Subject to any disclaimer, the term of this patent is extended or adjusted under 35 U.S.C. 154(b) by 0 days.

(21) Appl. No.: 14/614,339

(22) Filed: Feb. 4, 2015

(65) Prior Publication Data

US 2015/0222980 A1 Aug. 6, 2015

Related U.S. Application Data

(60) Provisional application No. 61/935,727, filed on Feb. 4, 2014.

(51) Int. Cl.

| | |
|---|---|
| ***H04R 25/00*** | (2006.01) |
| ***H04R 1/10*** | (2006.01) |
| *H04R 5/033* | (2006.01) |

(52) U.S. Cl.
CPC ..... *H04R 1/1058* (2013.01); *H04R 1/1008* (2013.01); *H04R 1/1075* (2013.01); *H04R 5/033* (2013.01)

(58) Field of Classification Search
CPC ..... H04R 1/1008; H04R 1/1016
USPC ..... 381/370–374
See application file for complete search history.

(56) References Cited

U.S. PATENT DOCUMENTS

| | | | | |
|---|---|---|---|---|
| 5,729,605 | A * | 3/1998 | Bobisuthi | H04R 1/225 379/430 |
| 2009/0232340 | A1* | 9/2009 | Yang | H04R 1/2811 381/371 |
| 2013/0195307 | A1* | 8/2013 | Mizuno | H04R 1/1091 381/374 |

* cited by examiner

*Primary Examiner* — Sunita Joshi
(74) *Attorney, Agent, or Firm* — Uleses C. Henderson, Jr.; One LLP

(57) ABSTRACT

A headset having rotatable ear cups. The headset includes a headband having a first end and a second end. An earphone unit is coupled to each end of the headband. The earphone unit includes an ear cup that is rotatable between a closed position and an open position.

17 Claims, 8 Drawing Sheets

HEADPHONES WITH ROTATABLE EAR CUP

CROSS-REFERENCE TO RELATED APPLICATION

This application claims priority to United States ("U.S.") Provisional Patent Application Ser. No. 61/935,727, entitled "Headphones With Rotatable Ear Cup," filed on Feb. 4, 2014, the disclosure of which is incorporated by reference herein in its entirety.

BACKGROUND INFORMATION

1. Technical Field

The present disclosure relates generally to headphones and, in particular, a headphone unit having a rotatable ear cup.

2. Background

When playing live music, for instance in a night club, music disc jockeys ("DJ's) often use headphones to listen to music that the DJ plans to mix or blend with music that is currently being performed. During this transition of mixing the music, for example to match the tempo of the two songs, the DJ often has to remove one side of the headphones (i.e., remove one earpiece from the DJ's ear) in order to hear the blending of the music. This exposes the DJ's ear to the loud music coming from the house or loud speakers, which can be harmful to the DJ's ear. Also, when the earpiece is removed from DJ's ear, the headphones are prone to slip off the DJ's head, which may interrupt the DJ's performance.

Similarly, recording artists, when singing in a sound booth, often use headphones to hear the music they are accompanying. However, the intensity of the music emanating from the headphones often makes it difficult for the artist to hear their own pitch. Therefore, the artist may, similar to the DJ, remove one earpiece from their ear or, in the alternative, the sound engineer may reduce the volume of sound coming through the headphones to enable the artist to better hear themselves. However, when the earpiece is removed from artist's ear, sound from the earpiece may bleed into the recording artist's microphone or the headphones, again, are prone to slip off of the artist's head, which may interrupt their performance. In the alternative, when the headphone volume is reduced, it may affect the singer's "vibe" with the music and/or cause the artist to strain to hear the same.

Thus, there is a need for a set of headphones that both condition the amplitude of sound entering the user's ears, and allows the user to hear ambient sound without having to remove the earpiece from the their ears.

SUMMARY

A headset having rotatable ear cups is provided. In one example, the headset includes a headband and an earphone unit coupled to each end of the headband, where the earphone unit includes an ear cup that is rotatable between a closed position and an open position.

In another example, the headset includes a headband coupled at opposite ends to a sliding member. An earphone unit is coupled to a free end of the each sliding members, where the earphone unit includes an ear cup that is rotatable between a closed position and an open position.

In yet another example, the headset includes a headband having a first end and a second end. An earphone unit is coupled to each end of the headband, where the earphone unit includes an earpiece and an adjustable sound conditioning system for conditioning sound passing through the earpiece.

A method for making a headset is also provided. In one example, the method includes providing an earphone unit having an ear pad and an ear cup, where the ear pad is adapted to be secured against a user's ear and the ear cup incorporates an electroacoustic transducer. The method further includes coupling the ear cup to the earphone unit such that ear cup may pivot towards or away from the ear pad while the ear pad remains secured against the user's ear.

Other devices, apparatus, systems, methods, features and advantages of the disclosure will be or will become apparent to one with skill in the art upon examination of the following figures and detailed description. It is intended that all such additional systems, methods, features and advantages be included within this description, and be protected by the accompanying claims.

BRIEF DESCRIPTION OF THE FIGURES

The present disclosure may be better understood by referring to the following figures. The components in the figures are not necessarily to scale, emphasis instead being placed upon illustrating the principles of the disclosure. In the figures, like reference numerals designate corresponding parts throughout the different views.

DETAILED DESCRIPTION

Figure 1:
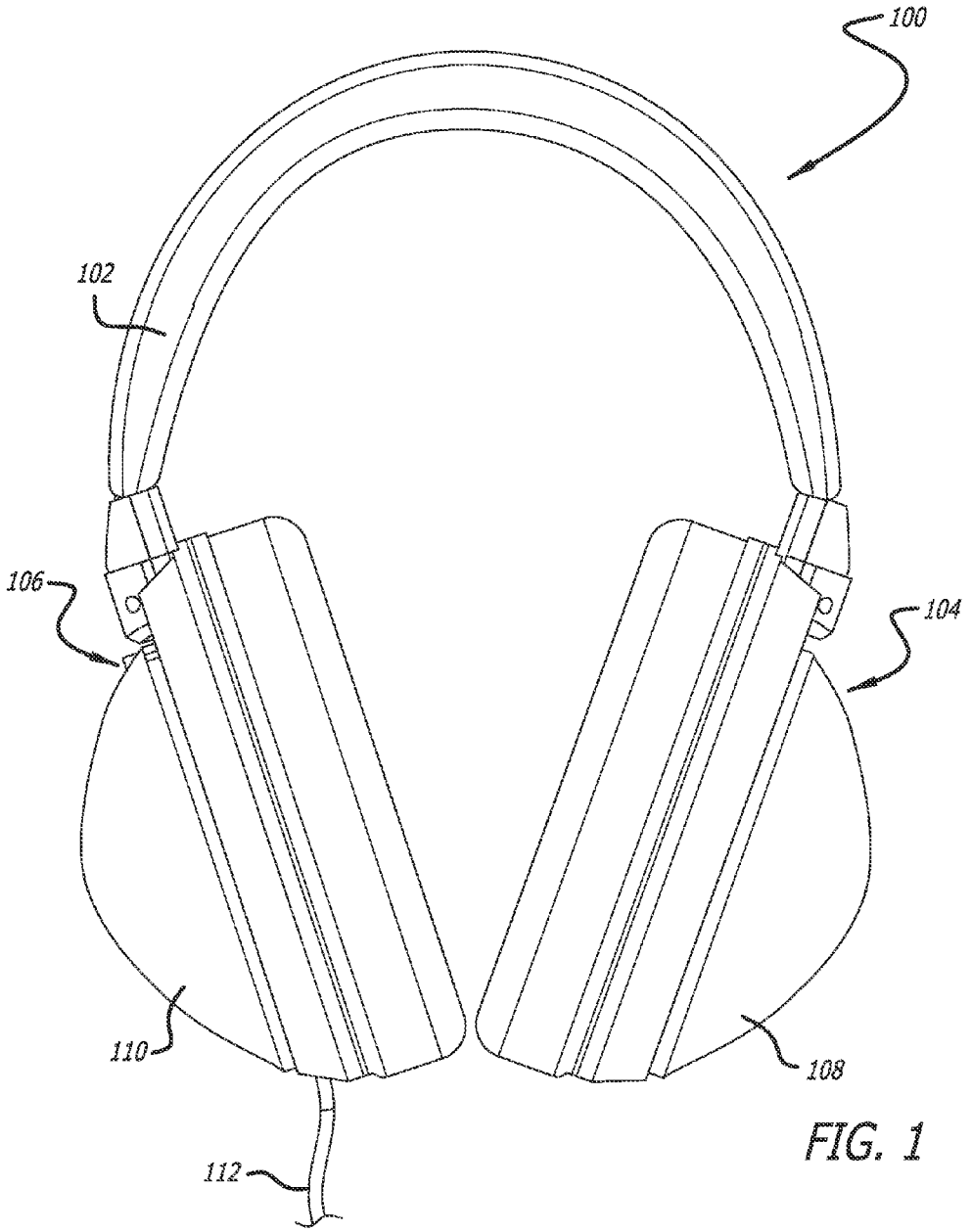
FIG. 1 is a front view illustrating one example of an implementation of a set of headphones according to the present disclosure.

FIGS. 1-8B illustrate various implementations of a set of headphones 100 having rotatable or translating ear cups. In one example implementation, as shown in FIG. 1, the set of headphones 100 may include a support band 102 and a pair of earphone units 104, 106 supported on opposite ends of the support band 102. The support band 102 may be worn over the user's head and is constructed to support the earphone units 104, 106 over the user's ears. Each earphone unit 104, 106 houses a speaker assembly enclosed within an ear cup 108, 110. As further described herein, each ear cup 108, 110 may be independently pivoted away from the user's ear (see e.g., FIG. 5) to enable the user to hear ambient sound without having to remove the entire earphone unit 104, 106 from the user's ear.

Figure 2:
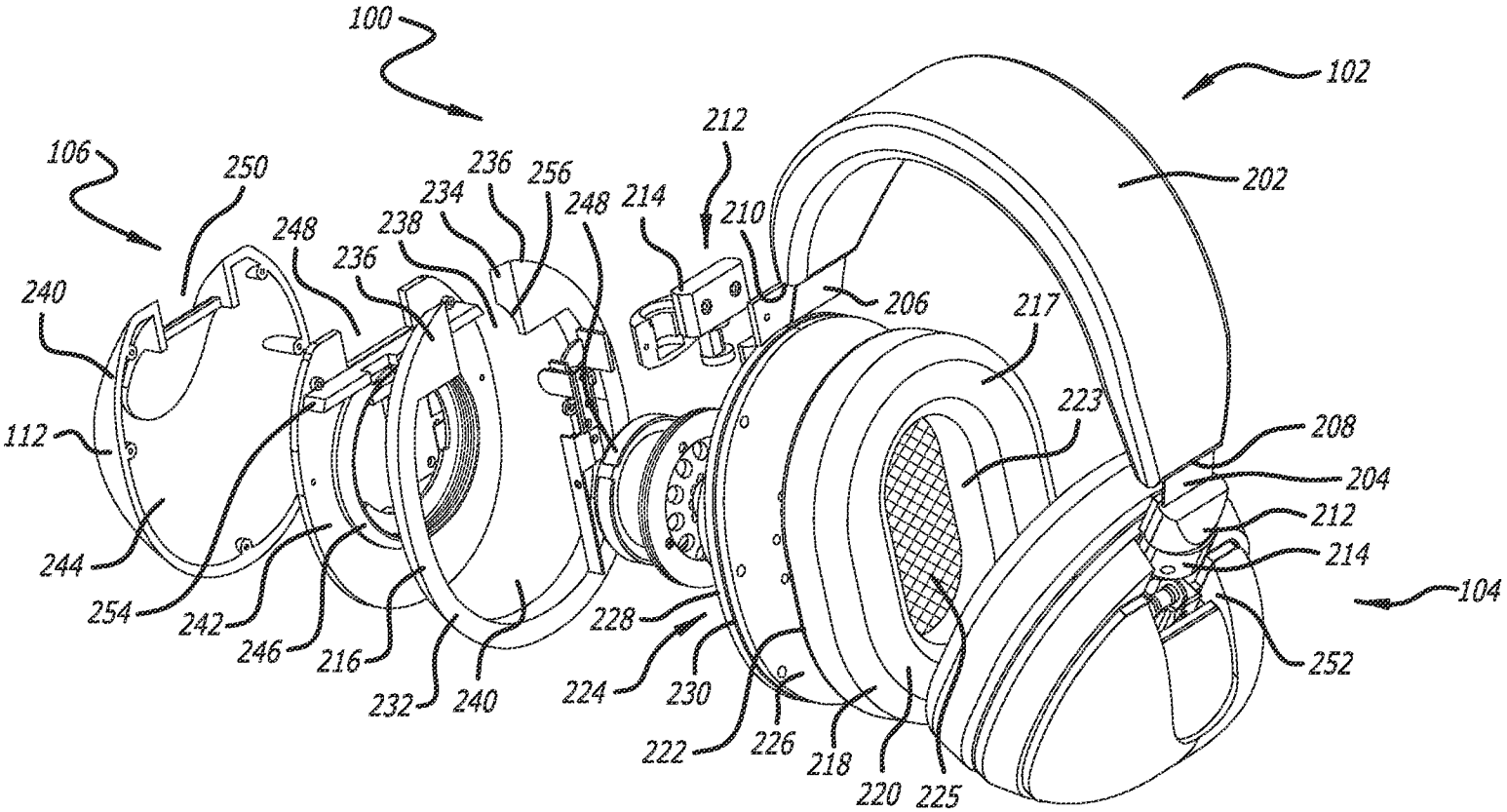
FIG. 2 is an exploded view of the headphones illustrated in FIG. 1.

FIG. 2 is an exploded view of the set of headphones 100. As shown, the support band 102 may be any device that supports the earphone units 104, 106 over or in a user's ear. In one example, as shown, the support band 102 is a headband having a central head-engaging portion 202 and a pair of adjustable arms 204, 206 adjustably coupled to opposite ends 208, 210 of the central portion 202. The central portion 202 and the adjustable arms 204, 206 may be constructed of abs plastic, fiberglass, ceramic, wood, steel, aluminum, or any other durable material. In some implementations, the central portion 202 may be padded with polyurethane foam, viscoelastic foam, rubber, leather, or other suitable material to provide comfort to the user's head.

The functionality of the adjustable arms 204, 206 is provided by the central portion 202. The adjustable arms 204, 206 may be pushed into or, alternatively, pulled out from the central portion 202 to adjust the fit of the earphone units 104, 106 over the user's ears. In particular, each adjustable arm 204, 206 may be slidably inserted into slots formed at the opposite ends 208, 210 of the center portion 202. By adjusting the insertion length of the adjustable arms 204, 206 according to the head shape of the user, the length of the support band 202 is adjusted.

Each adjustable arm 204, 206 may further include coupling members 212 for coupling the adjustable arms 204, 206 to the earphone units 104, 106. In the implementation shown, the coupling member 212 includes a strut 214 for connecting the earphone units 104, 106 in fixed relation to ends of the adjustable arms 204, 206. In other implementations, the earphone units 104, 106 may be coupled to the adjustable arms 204, 206 by a yoke (not shown) that permits the earphone units 104, 106 to rotate and/or pivot relative to the support band 202. In yet another implementation, the adjustable arms 204, 206 may include pivot joints or hinges that permit the adjustable arms 204, 206 to be folded in half and the earphone units 104, 106 to be collapsed within the support band 102 during storage.

Turning now to the earphone units, each earphone unit 104, 106 may include a frame 216 coupled between an ear pad 217 and the ear cup 112. Because the components of each earphone unit 104, 106 are generally the same, only the components of earphone unit 106 are described herein for simplicity.

Starting with the ear pad 217, the ear pad 217 includes a body 218 made of soft, flexible material, such as rubber, cloth, leather, or any other durable compliant material. As shown, the body 218 may be oval shaped, but in other implementations the body may be circular or any other suitable geometry. In the present implementation, the body 218 may be padded, for example with foam, to cushion the user's ear. The body 218 includes a front surface 220 and a back surface 222. The front surface 220 of the body 218 is configured to rest against the ear of the user.

The ear pad body 218 forms an opening 223 for channeling sound to the user's ear. In some implementations, a cloth or mesh fabric 225, extending across the ear pad opening 223, may be affixed to the back surface of the body 218 to protect the user's ear from the earphone unit 106 components.

The ear pad 217 further includes a sound conditioning gasket 224 coupled to the back surface 222 of the ear pad body 218 by fasteners, mechanical bonding, or other suitable means. The gasket 224 includes a front plate 226, a rear plate 228, and a sound conditioning system 230 disposed between the front plate 226 and the rear plate 228. The front plate 226 and the rear plate 228 may be made of injection molded plastic, ceramic, non-magnetic metal, or any other suitable material. As shown, the front plate 226 and the rear plate 228 may be oval in shape but, generally, the front plate 226 and the rear plate 228 may conform to the shape and dimensions of the ear pad body 218. The sound conditioning gasket 224 functions to condition the sound waves propagating from the transducers disposed in the earphone units 104, 106.

According to the implementation shown in FIG. 2, the sound conditioning system 230 may include an insert comprising a sheet of open-cell sound dampening material, for example an open-cell polyethylene, polyurethane, or polypropylene foam, that is glued or otherwise bonded between the front plate 226 and the rear plate 228. In implementations where the front plate 226 and the rear plate 228 are coupled together by fasteners, the sound conditioning properties (i.e., the mechanical and acoustic performance) of the open-cell material may be adjusted by fastening the front plate 226 and the rear plate 228 closer together. By fastening the front plate 226 and the rear plate 228 closer together, the cells of the open-cell material are compressed which, in turn, absorbs acoustic energy and restricts the passage of sound waves propagating through the material. Thus, the amplitude of sound heard by the user through the ear pad 217 may be adjusted by adjusting the spacing between the front plate 226 and away the rear plate 228. In addition to adjusting the spacing between the front plate 226 and the rear plate 228, the amplitude of attendant sound may be adjusted by using sound dampening materials of various thicknesses and mechanical properties. Further, in some implementations, damaged or worn inserts may be replaced by the manufacturer or user.

Figure 3:
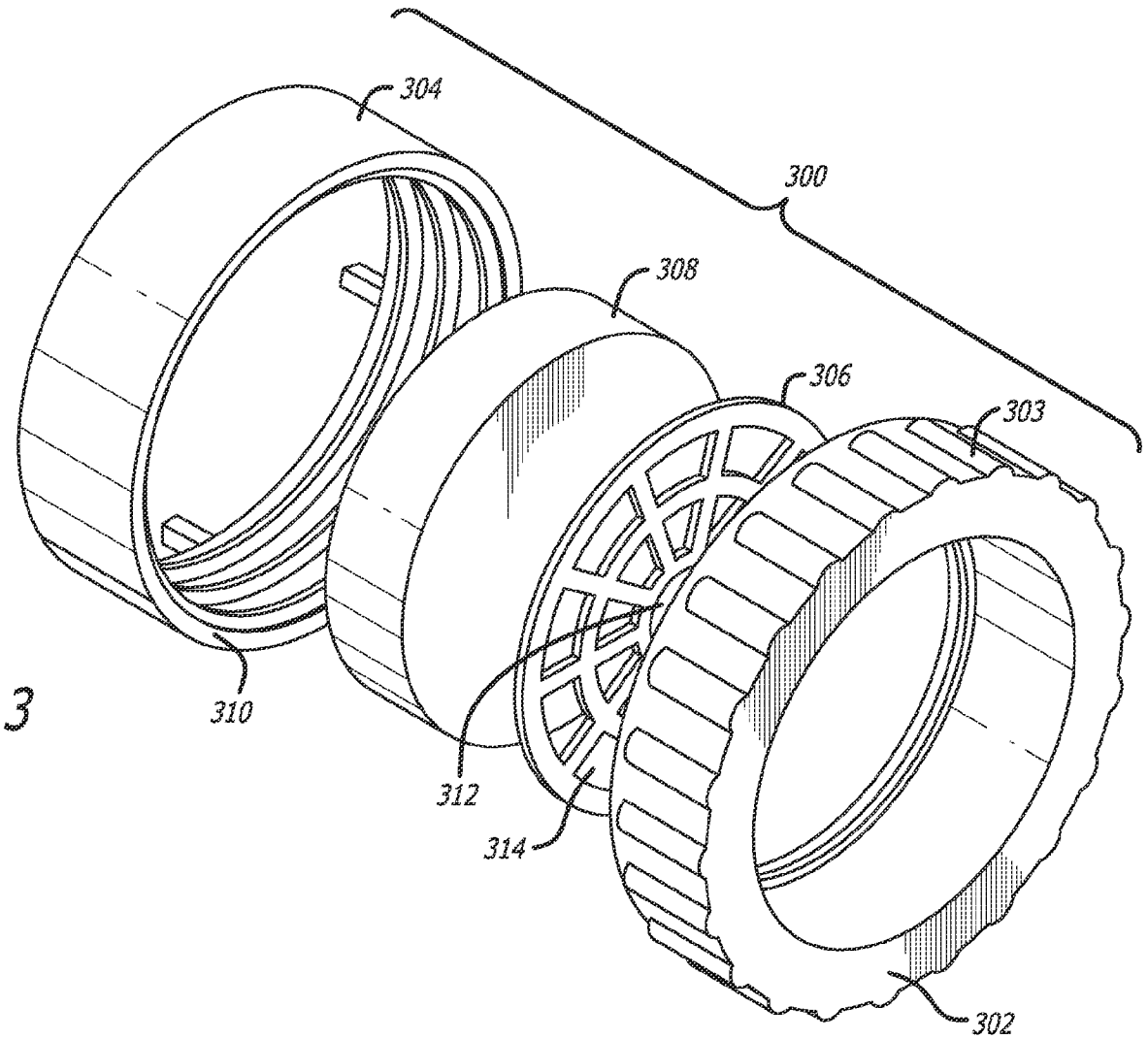
FIG. 3 is an exploded view of one example of an implementation of a sound conditioning system according to the present disclosure.

FIG. 3 is an exploded view of another example of an implementation of a sound conditioning system 300 according to the present disclosure. According to this implementation, the amplitude of sound heard by the user may be manually adjusted by the user.

The sound conditioning system 300 includes a rotary dial 302 having digits 303 formed about its periphery, a stationary case member 304, a compression plate 306, and a conditioning insert 308. The rotary dial 302 is configured to threadedly engage the stationary case 304 to adjust the compression of the compression plate 306 on the conditioning insert 308 disposed therebetween. As better shown in FIG. 4, recesses 401 and 403 formed in interior surfaces of the front plate 226 and a rear plate 228, respectively, define an enclosure 405 that encloses the sound conditioning system 300.

The rotary dial 302 is of hollow annular construction having an outer annular wall 402 and an inner annular wall 404 joined together by a top wall 406 at one end, and defining between them an annual space 408 open at the other end for receiving a body portion of the stationary case 304. The outer annular wall 402 and the inner annular wall 404 define a central axis 410. The outer annular wall 402, the inner annular wall 404, and the top wall 406 may be integrally formed from abs plastic, fiberglass, ceramic, wood, steel, aluminum, or any other durable material.

Male threads 412 are formed along an outer surface of inner annular wall 404. The male threads 412 are constructed to threadingly engage complementary female threads carried by the stationary case member 304, as will be discussed in further detail below. The inner annular wall 404 further includes an annular landing portion 414. The annular landing portion 414 extends inwards (i.e., towards the central axis 410) from an inner surface 416 of the inner annular wall 404. The annular landing portion 414 is constructed to apply compression on the compression plate 306 to compress the plate on the conditioning insert 308. The landing portion 414 and the inner surface 416 of the inner annular wall 404 define a seat 418 that encloses the compression plate 306 the conditioning insert 308. It is preferred that the axial length of the inner annular wall 404 is equal to or greater than the axial length of the outer annular wall 402 to ensure that the compression plate 306 and conditioning insert 308 are fully compressed when the threads of the rotary dial 302 are fully engaged with the threads of the stationary case member 304. When assembled, a rear annular face 420 of the inner annular wall 404 may be affixed to the interior surface of the rear plate 228 by gluing, welding, soldering, bonding, or any other suitable means.

The stationary case member 304 is a cylinder having an outer cylindrical surface 422, an inner cylindrical surface 424, a front face 426, and a rear face 428. The inner cylindrical surface 424 defines an axis that is coaxial with the central axis 410. The stationary case member 304 may be constructed from abs plastic, fiberglass, wood, steel, aluminum, or any other durable material.

Female threads 310 (best shown in FIG. 3) are formed along the inner cylindrical surface 424 of the stationary case member 304. The female threads 310 are constructed to complement the male threads 412 of the rotary dial 302 such that the rotary dial 302 rotates about the central axis 410, translating between a first axial position and a second axial position (as denoted by arrow 430). In the first axial position, the top wall 406 is engaged with the front face 426 of the stationary case member 304 and the conditioning insert 308 is compressed to a compressed position. In the second position, the top wall 406 is engaged with the interior surface of the front plate 226 and the conditioning insert 308 is decompressed to a substantially uncompressed position. It is further preferred to machine the stationary case member 304 to dimensions providing a clearance fit between the outer cylindrical surface 422 of the stationary case member 304 and the inner surface of the outer annular wall 402. The rear face 428 of the stationary case member 304 may be affixed to the inner surface of the rear plate 228 by gluing, welding, soldering, bonding, or any other suitable means.

Figure 4:
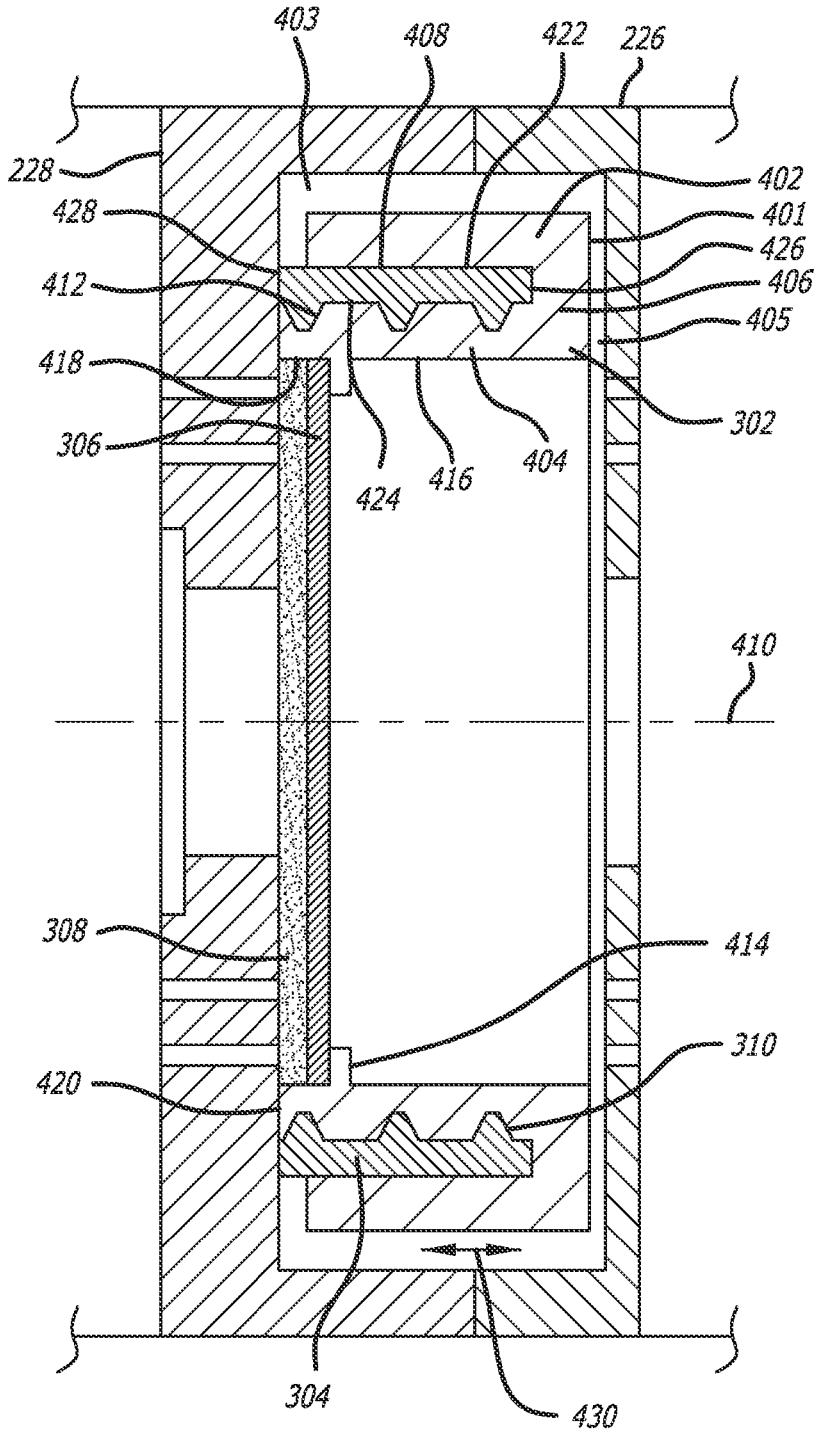
FIG. 4 is a partial cross-sectional view of the sound conditioning system illustrated in FIG. 3 incorporated into the gasket of an earphone unit according to the present disclosure.

Turning back to FIG. 3, the compression plate 306 comprises a thin circular disc having a central bore 312 and a plurality of spaced and concentrically arranged cut-out portions 314. As best shown in FIG. 4, the compression plate 306 has a thickness such that it fits within the seat 418 and radial dimensions corresponding with the dimensions of the inner surface 416 of the inner annular wall 404. The compression plate 306 may be constructed of plastic, fiberglass, wood, steel, ceramic, aluminum, or any other suitable material, although it may be preferred to construct the compression plate 306 of the same material as the stationary case member 304.

The conditioning insert 308 may comprise a solid circular disc made of open-cell polyethylene, polyurethane, or polypropylene foam, viscoelastic foam, or other suitable material that is glued or otherwise bonded to the rear plate 228. The conditioning insert 308 may be constructed to radial dimensions corresponding with the dimensions of the compression plate 306 and the inner surface 416 of the inner annular wall 404.

The compression plate 306 functions as a bearing surface, in that, when the rotary dial 302 is rotated clockwise, the male threads 412 of the rotary dial 302 engage the female threads 310 of the stationary case member 304 to translate the annular landing 414 towards the rear plate 228 which, in turn, causes the compression plate 306 to bear against the conditioning insert 308 to compress the insert. In the alternative, if the rotary dial 302 is rotated counterclockwise, the annular landing 414 is translated away from the rear plate 228 and the resilient properties of the conditioning insert material cause the conditioning insert 308 to return to its original uncompressed form.

The sound conditioning properties of the conditioning insert 308 are altered as the insert is compressed. As discussed above, the more the cells of the conditioning insert's open-cell material are compressed, the more the acoustic energy of the sound waves propagating through the material are absorbed and the passage of sound waves is restricted. As the cells are decompressed back to their original state, more sound is permitted to pass through the material. Thus, the amplitude of sound heard by the user through the ear pad 217 may be adjusted by adjusting the rotary dial 302. In some implementations, the amplitude of sound may be adjusted (i.e., dampened) between approximately 5 decibels and 30 decibels or more.

Returning to FIG. 2, the frame 216 comprises a substantially U-shaped member having a front face 232, a rear face 234, and a pair of spaced apart ends 236 forming a slot 238. The frame 216 is configured to prevent ambient sound from leaking into the earphone unit 104 interior (i.e., sound proofing) when the ear cup 112 is sealed in its closed position. The frame 216 defines an opening 204 for passing an electroacoustic transducer 218 therethough. The frame 216 may be made of wood, plastic, metal or any other suitable material.

The front face 232 of the frame 216 may be glued, welded, or otherwise bonded to the exterior surface of the rear plate 228. However, the rear face 234 of the frame 216 is not affixed to the ear cup 112 but, instead, the rear face 234 defines a surface that the ear cup 112 mates or bears against to form a bearing seal when the ear cup 112 is rotated to its closed position. In some implementation, the rear face 234 may be coated with a layer of fabric to enhance the seal between ear cup 112 and the frame 126. Implementations that incorporate a wood frame 214 assist the user in locating where the ear cup 112 separates from the rest of the earphone unit 104 by providing tactical feedback to the user's hand so the user can gauge the location of the ear cup 104 by touch, rather than visually.

Moving now axially downstream, the ear cup 112 includes an end cap 240 and cap cover 242. The end cap 240 and cap cover 242 define a hollowed interior 244. The cap cover 242 may be attached to the end cap by fasteners, welding, gluing, or bonding or other suitable means. The ear cup 112 may be made of abs plastic, fiberglass, ceramic, steel, aluminum, or any other suitable material.

The cap cover 242 includes an orifice 246 adapted to mount an electroacoustic transducer 248 therewithin. The basic design and components of electroacoustic transducers incorporated into headsets are well-known in the art and further description is not required herein. In some implementations, the transducer 248 may include noise cancelling or sound-isolating components. The hollowed interior 242 defines an acoustic basket enclosure for the transducer 248. In implementations where the headphones are battery powered, batteries and circuitry may be housed in the hollowed interior 242.

The ear cup 112 further includes a corresponding pair of notches 248 and 250 formed in an upper portion of the cap cover 242 and end cap 240, respectively. The notches 248 and 250 define an upper recessed portion 252 of the ear cup 112 that enables the ear cup 112 to be rotated upwards (i.e., counterclockwise) without being restricted by the strut 214.

In some implementations, the cap cover 242 may further include a seal 254 comprising, for example, a strip of foam or rubber. The seal 254 may be adapted to engage a recessed portion 256 of the rear face 234 to provide an additional acoustic seal between the ear cup 112 and the frame 216.

Figure 5:
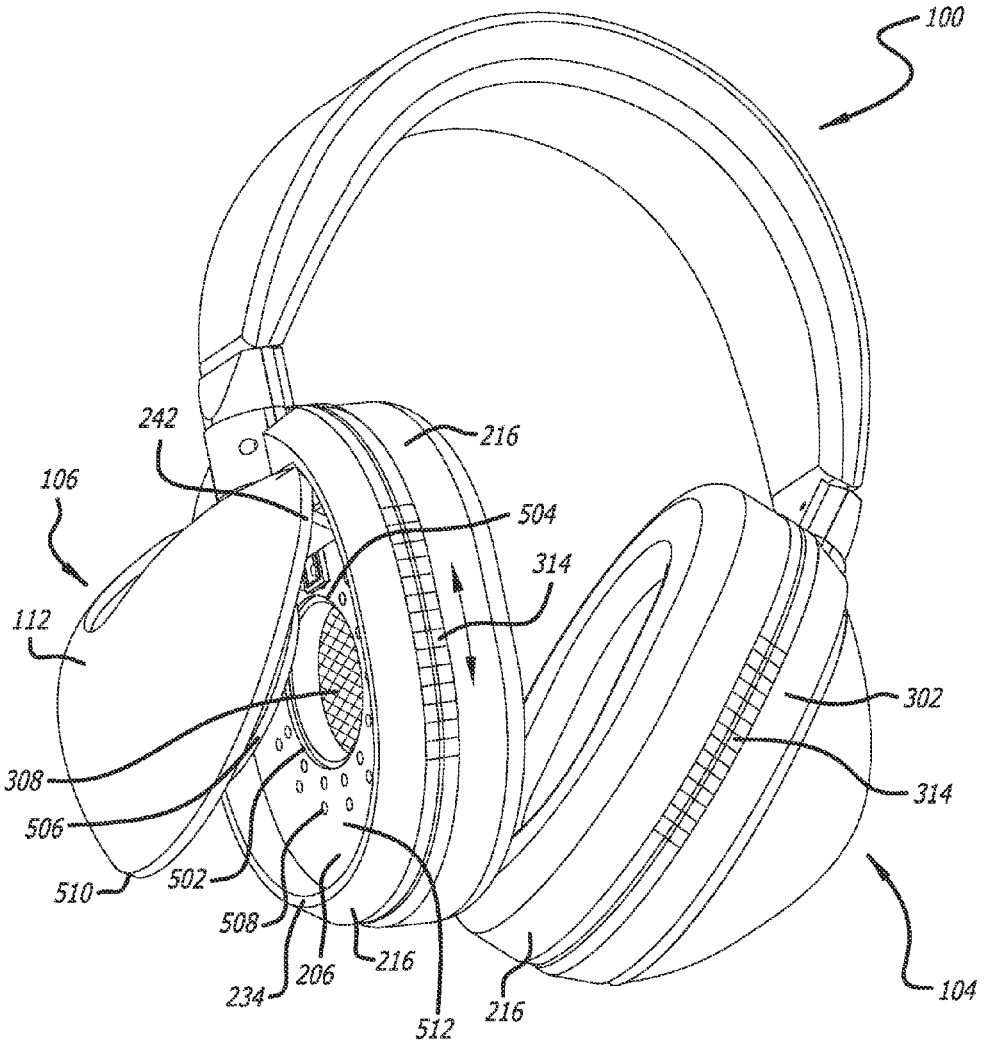
FIG. 5 is a perspective view illustrating one example implementation of a set of headphones incorporating the sound conditioning system illustrated in FIG. 3.

FIG. 5 is a perspective view of headphones 100 showing one earphone unit 104 enclosed with its respective ear pad 217, and the other earphone unit 106 rotated away from its respective ear pad 217. In particular, this view shows that the gasket 206 further includes a central bore 502 having a countersunk portion 504 for receiving a speaker portion 506 of the electroacoustic transducer 248 (FIG. 2). The central bore 502 channels ambient sound and sound passing from the electroacoustic transducer 248 through the conditioning insert 308 to the user's ear.

The gasket 206 also includes a plurality of concentrically arranged perforations 508 for conditioning sound waves propagating from the ambient air and the electroacoustic transducer to the user's ear. In some implementations, the perforations 304 may increase in size with increasing radial dimensions to enhance sound quality.

As shown, the ear cup 112 defines a seat 510 extending about the periphery of the cap cover 242. The seat 510 has dimensions corresponding to the dimensions of the opening 240 such that when outer edges of the ear cup 112 abut against the rear face 234 of the frame 216, for example when the earphone unit 104, 106 is rotated to its closed position, the cap cover 242 rests within the opening 240. The seat 510 provides an acoustic seal between the ear cup 112 and the frame 216. Thus, the gasket 206, frame 216 and the cap cover 242 define a sound proof enclosure 512 for isolating ambient sound.

FIG. 5 also shows that the outer shell of the ear cup 112 may include an ergonomic design to aid the user's handling of the ear cup. FIG. 5 further shows how the dial digits 314 may be adjusted along the sides of the earphone units 104, 106 to adjust the amount of sound conditioned by the sound conditioning system 300.

Figure 6:
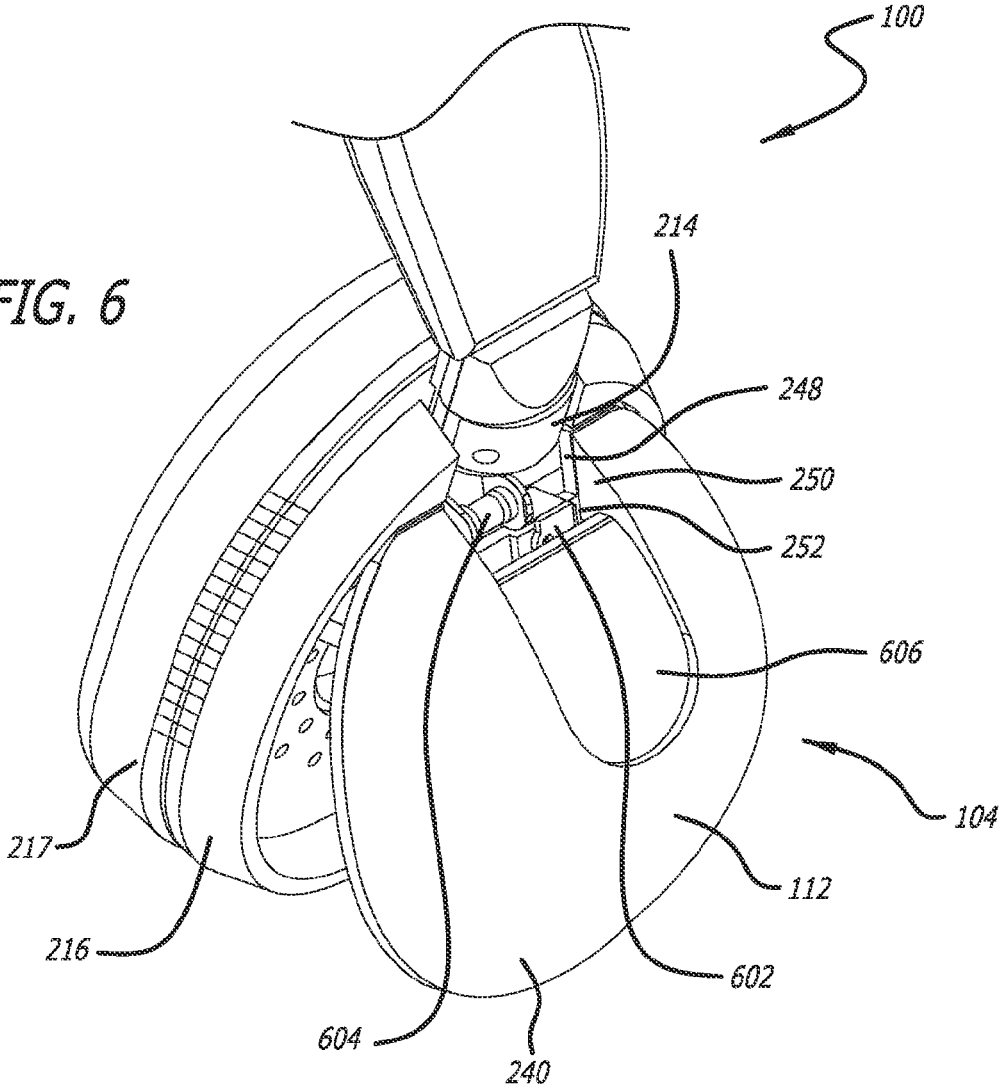
FIG. 6 is a partial perspective view illustrating the set of headphones illustrated in FIG. 5.

FIG. 6 is a partial perspective view of earphone unit 104 in an open position. As better shown here, the upper recessed portion 252 of the ear cup 112, formed by notches 248 and 250, permits the ear cup 112 to be rotated upwards (i.e., counterclockwise) without being restricted by the strut 214. Also shown is a pivot arm 602 pivotably coupled to the gasket 224 about a spring-loaded hinge 604. The pivot arm 602 is coupled to the ear cup 112 to pivot the ear cup 112 relative to the ear pad 217. In some implementations, the pivot arm 602 may include a ratcheting or detent means for supporting the ear cup 112 in different rotational positions. The exterior of the end cap 240 may also include a finger detent 606 for griping and handling the ear cup 112.

Figure 7A:
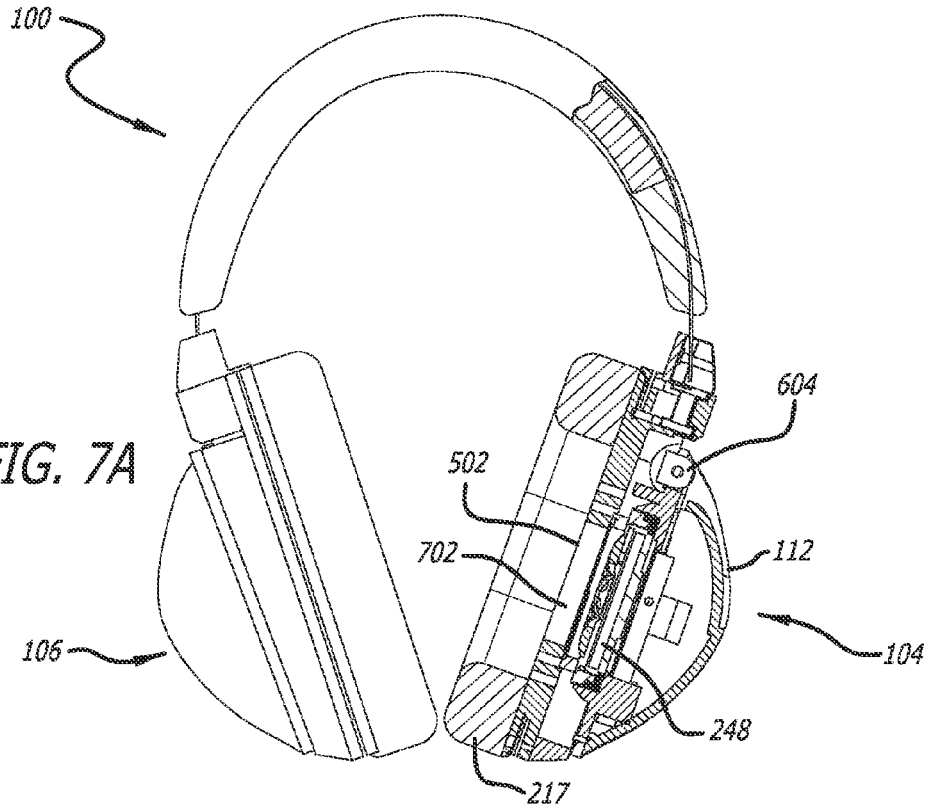
FIG. 7A is a partial cross-sectional view of the headphones illustrated in FIG. 1, wherein both headphone units are in a closed position.

As previously mentioned, the ear cups 112 may be movable from a closed position to an open position. FIG. 7*a* is a front partial cross-sectional view of the headphones 100 with the ear cups 112 in a closed position. In the closed position, the transducer 248 is positioned proximate the users ear for standard listening. In this position, the ear cup 112 abuts and is enclosed with the ear pad 217 such that a speaker portion 506 of the transducer 248 rests within the countersunk portion 504 of the central bore 502 to provide sound directly to the user's ear. The central bore 502, together with enclosure 512, defines a substantially sound proof enclosure for isolating ambient sound and permitting only sound transmitted from the transducer 248 to enter the user's ear.

Figure 7B:
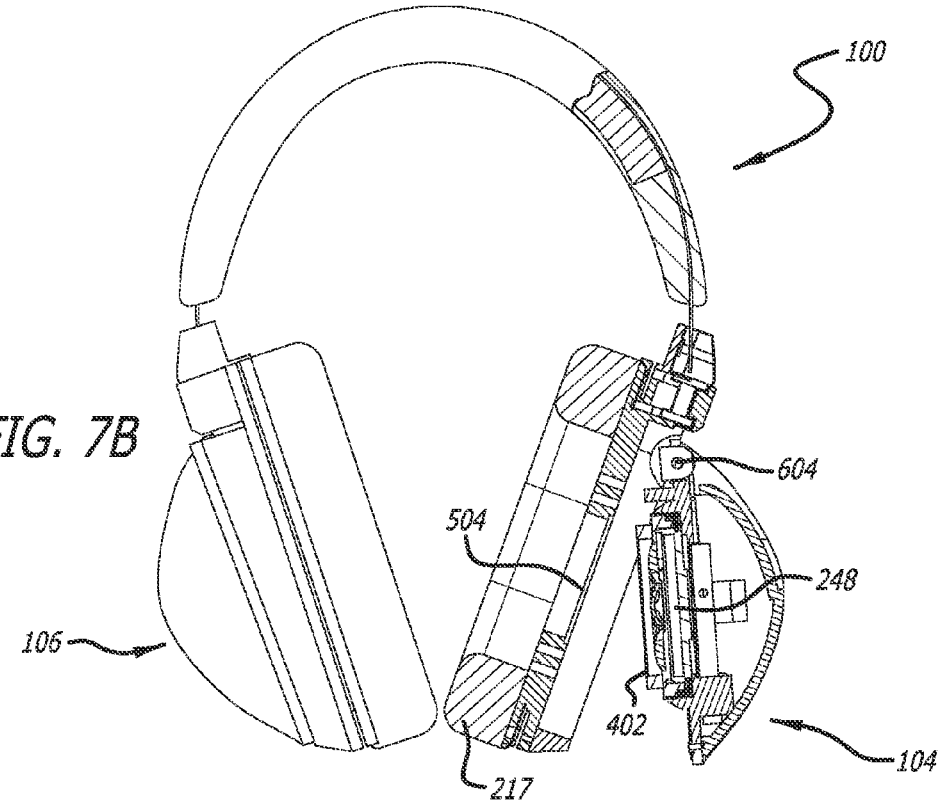
FIG. 7B is a partial cross-sectional view of the headphones illustrated in FIG. 1, wherein one of the headphones units is rotated to an open position.

FIG. 7*b* is a front partial cross-sectional view of the headphones 100 where the ear cup 112 of the right headphone unit 104 is rotated to an open position. In the open position, the transducer 248 is rotated away from the user's ear to allow the user to hear ambient sound. In particular, the ear cup 112 is rotated about hinge 404, away from the ear pad 217. In the open position, the user is able to hear ambient sound without having to remove the headphone unit 104 from the user's ear. The ear cup 112 may be rotated, for example, from between 0° and 90° relative to the ear pad 217. The present invention is particularly useful for music disc jockeys who wish to simultaneously hear the sound being mixing in a turntable as well as the ambient sound currently being heard by the listening audience.

Figure 8A:
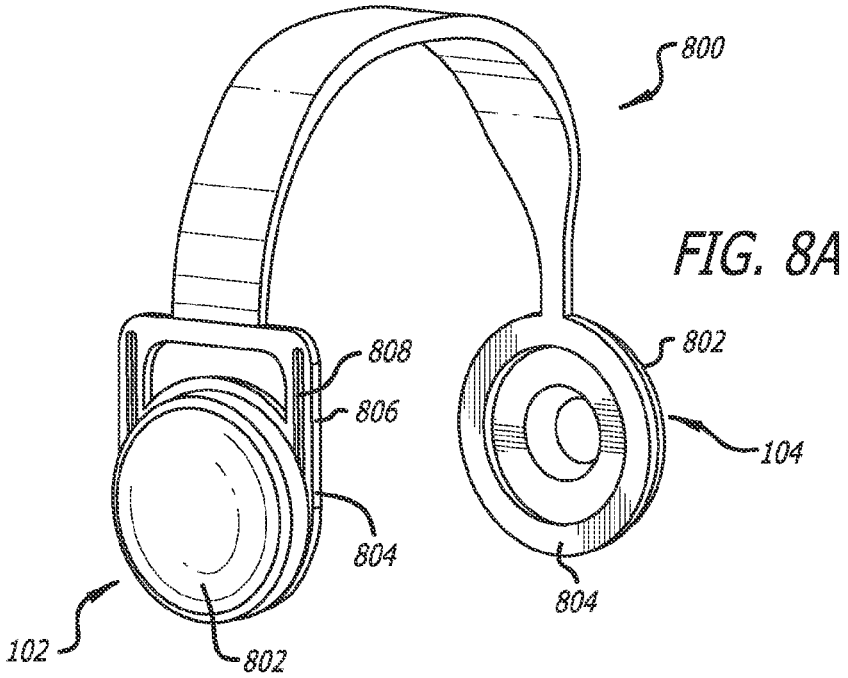
FIG. 8A is a perspective view illustrating another example of an implementation of a set of headphones according to the present disclosure, wherein the headphone units are in a closed position.
Figure 8B:
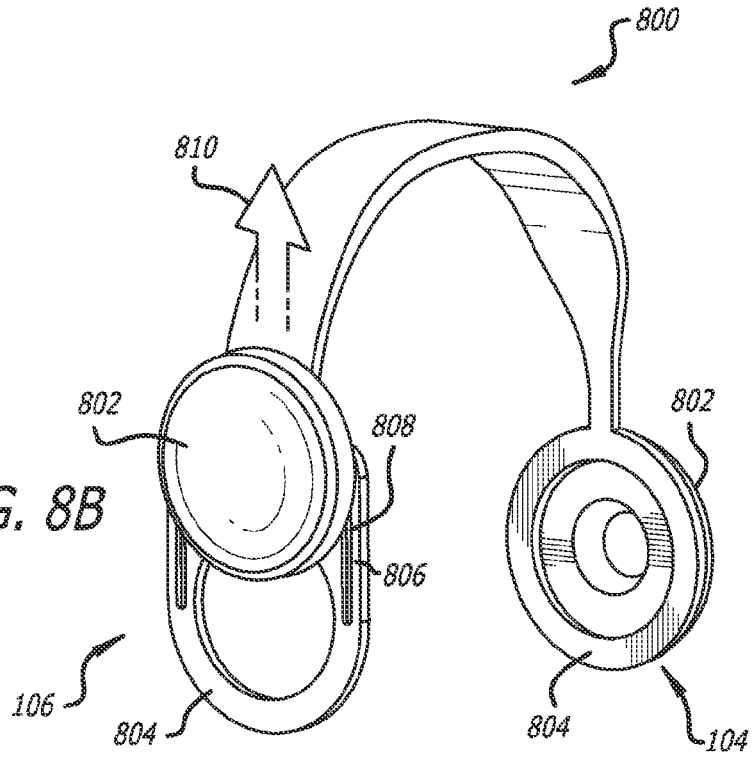
FIG. 8B is a perspective view of the headphones illustrated in FIG. 8A, wherein the one of the headphones units is rotated to an open position.

FIGS. 8A and 8B are schematic views showing another example implementation of a set of headphones 800 according to the present disclosure. According to this implementation, the ear cups 802 may be translated or slid away from and toward the ear pad 804. In such implementations, a track 806 having channels 808 may be integrally formed with the ear pad 804. The ear cups 802 may carry ratchet or friction pins (not shown) that engage the channels 808, such that the ear cups 802 may be moved to different linear positions over or away from the user's ears, as denoted by arrow 810.

Headphones according to the present invention may be electronically coupled to an audio transmitting device by a wired or wireless (e.g. a Bluetooth) connection. For example, a cord 112 (FIG. 1) may extend from one or both of the ear pieces to provide an electrical pathway for transmitting an audio signal to the transducers or drivers fitted in the ear pieces, or, in the alternative, the transducers or drivers in the ear pieces of the headphones may wirelessly receive an audio signal. Headphone units according to the present disclosure may also apply to headphone units supported directly by the user's ear, such as ear buds, ear phones and the like.

In general, terms such as "coupled to," and "configured for coupling to," and "secured to," and "configured for securing to" and "in communication with" (for example, a first component is "coupled to" or "is configured for coupling to" or is "configured for securing to" or is "in communication with" a second component) are used herein to indicate a structural, functional, mechanical, electrical, signal, optical, magnetic, electromagnetic, ionic or fluidic relationship between two or more components or elements. As such, the fact that one component is said to be in communication with a second component is not intended to exclude the possibility that additional components may be present between, and/or operatively associated or engaged with, the first and second components.

The foregoing description of implementations has been presented for purposes of illustration and description. It is not exhaustive and does not limit the claimed inventions to the precise form disclosed. Modifications and variations are possible in light of the above description or may be acquired from practicing the invention. The claims and their equivalents define the scope of the invention.

What is claimed is:

1. A headset comprising:

a headband having a first end and a second end; and an earphone unit coupled to each end of the headband, the earphone unit including an ear pad, an ear cup that is rotatable relative to the ear pad between a closed position and an open position, a transducer coupled to the ear cup for transmitting sound to the user's ear, and a gasket having a thickness and a central bore extending therethrough, the central bore defining a sound proof enclosure for preventing ambient sound from entering the user's ears when the ear cup is in the closed position.

2. The headset of claim 1, wherein earphone unit further includes a pivot about the ear cup may rotate towards or away from the ear pad.

3. The headset of claim 1, wherein the ear cup is rotatable between a closed position proximate the ear pad and an open position rotated away from the ear pad.

4. The headset of claim 1, wherein a user primarily hears sound transmitted from the transducer when the ear cup is in the closed position, and wherein the user is permitted to hear ambient sound when the ear cup is rotated to the open position.

5. A headset comprising:

a headband having a first end and a second end; and an earphone unit coupled to each end of the headband, the earphone unit including a sound conditioning system, an ear pad, an ear cup that is moveable between a first position and a second position, a transducer coupled to the ear cup for transmitting sound to the user's ear, and a gasket having a thickness and a central bore extending therethrough, the central bore defining a sound proof enclosure for preventing ambient sound from entering the user's ears when the ear cup is in the first position.

6. The headset of claim 5, wherein earphone unit further includes a pivot about which the ear cup may rotate towards or away from the ear pad.

7. The headset of claim 5, wherein the ear cup is rotatable between a first position proximate the ear pad and a second position rotated away from the ear pad.

8. The headset of claim 5, wherein the ear cup may be linearly translated between a first position proximate the ear pad and a second position offset from the ear pad.

9. The headset of claim 5, wherein a user primarily hears sound transmitted from the transducer when the ear cup is in the first position, and wherein the user is permitted to hear ambient sound when the ear cup is moved to the second position.

10. The headset of claim 5, wherein the sound conditioning system is configured to dampen the amplitude of sound passing through the ear pad to the user's ears.

11. The headset of claim 5, wherein the amount of sound dampened by the sound conditioning system is manually adjusted by the user.

12. A headset comprising:

a headband having a first end and a second end; and an earphone unit coupled to each end of the headband, where the earphone unit includes an earpiece and an adjustable sound conditioning system for dampening the amplitude of sound passing through the earpiece, the adjustable sound conditioning system including a gasket having a thickness and a central bore extending therethrough, the central bore defining a sound proof enclosure for preventing ambient sound from entering the user's ears when an ear cup of the earpiece is pivoted to a closed position.

13. The headset of claim 12, wherein the amount of sound dampened by the sound conditioning system is manually adjusted by the user.

14. The headset of claim 13, wherein the earpiece includes a gasket that enclosed the sound conditioning system, the sound conditioning system including a dial that may be rotated to adjust the amount of sound dampened by the sound conditioning system.

15. The headset of claim 1, wherein the earphone unit further includes a transducer for transmitting sound to the user's ear, the transducer being coupled to an ear cup.

16. A method for making headphones, the method comprising:

constructing an earphone unit comprising an ear pad and an ear cup, the ear pad being adapted to be secured against a user's ear, the ear cup incorporating an electroacoustic transducer;

constructing a sound conditioning system for dampening sound passing through the ear pad, the sound conditioning system including a gasket having a thickness and a central bore extending therethrough;

coupling the sound conditioning system to the ear pad;

coupling the ear cup to the earphone unit such that the sound conditioning system is positioned between the ear pad and the ear cup and the ear cup may pivot towards or away from the ear pad while the ear pad remains secured against the user's ear, wherein the central bore of the gasket defines a sound proof enclosure for preventing ambient sound from entering the user's ears when an ear cup of the earpiece is pivoted towards the ear pad.

17. The method of claim 16, wherein the amount of sound dampened by the sound conditioning system may be manually adjusted by the user.

* * * * *